US007126592B2

(12) United States Patent
Willis et al.

(10) Patent No.: US 7,126,592 B2
(45) Date of Patent: Oct. 24, 2006

(54) FORMING MODULATED SIGNALS THAT DIGITALLY DRIVE DISPLAY ELEMENTS

(75) Inventors: Thomas E. Willis, Mountain View, CA (US); Samson Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 311 days.

(21) Appl. No.: 10/227,957

(22) Filed: Aug. 26, 2002

(65) Prior Publication Data

US 2004/0046752 A1 Mar. 11, 2004

(51) Int. Cl.
*G09G 5/00* (2006.01)

(52) U.S. Cl. ..... 345/204; 345/691; 345/94

(58) Field of Classification Search ..... 345/63, 345/98, 264, 690–693, 204, 208, 211, 94
See application file for complete search history.

(56) References Cited

U.S. PATENT DOCUMENTS 5,317,401 A * 5/1994 Dupont et al. ..... 345/98
5,914,764 A 6/1999 Henderson
5,917,464 A 6/1999 Stearns
6,005,634 A * 12/1999 Lam et al. ..... 345/213
6,429,858 B1 * 8/2002 Janssen et al. ..... 345/204
2002/0080127 A1 * 6/2002 Park et al. ..... 345/204
2003/0227448 A1 * 12/2003 Janssen et al. ..... 345/204

* cited by examiner

*Primary Examiner*—Jimmy H. Nguyen
(74) *Attorney, Agent, or Firm*—Trop, Pruner & Hu, P.C.

(57) ABSTRACT

A controller to programmably provide stored values of drive control data (e.g., a ramp value) to a display device. Using the stored values of drive control data, modulated signals, such as pulse width modulation waveforms may be formed to digitally drive display elements of a display device, as an example. In a display refresh period, a first count indicative of a modulation characteristic may be compared to a stored value that corresponds to the first count. This comparison may determine an update for a second count indicative of a display data characteristic based on the stored value. Because only unique stored values may be stored in a programmable storage device, such as a look-up-table, a relatively smaller number of table entries may be stored and programmed in one embodiment. This may substantially reduce the size of the look-up-table and significantly decrease programming time and effort.

29 Claims, 4 Drawing Sheets

FORMING MODULATED SIGNALS THAT DIGITALLY DRIVE DISPLAY ELEMENTS

BACKGROUND

The present invention relates generally to electro-optical displays, and more particularly to forming modulated signals that digitally drive display elements.

Typically, a display system includes a display device that receives drive control information for driving display elements, displaying desired content. More specifically, for digitally driving a display device a commonly shared drive control data may be sent to each display element as a reference signal in addition to appropriate per-pixel display data (e.g., a pixel value). For example, an array of display elements (e.g., pixels) in a display device may be driven using drive signals, such as modulated waveforms that may be formed based on the common drive control data and per-pixel display data. In doing so, each modulated waveform may be individually formed to drive a different pixel of the display device. However, there are many ways to generate these drive signals.

One approach to form drive signals in display systems involves using pulse width modulation (PWM). By generating pulse width modulated waveforms, pixels with available digital storage, such as in liquid crystal displays (LCDs) may be appropriately driven. In one pixel architecture, per-pixel circuitry may modulate the orientation of liquid crystal (LC) material of a pixel.

To generate a modulating signal, such as a PWM waveform, a refresh period (or modulation cycle) may be divided into "m" discrete steps. For these steps, a counter may keep a step count as a counter value. At each step, the per-pixel circuitry may elect to change the state of the pixel based on the step count and pixel value of the pixel. Typically, the per-pixel circuitry makes the state transition decision by mapping a counter value from an interval counter (e.g., an m-bit counter) into an n-bit space (where "n" is the number of bits in the per-pixel display data). For example, by asserting that the state of the PWM waveform for a pixel of value "p" is 0 if "p" is less-than the mapping of the current counter value of the interval counter onto the n-bit space, a programmable storage device, such as a look-up-table (LUT) may enable this n-bit space mapping.

Using the m-bit counter output onto a different set of numbers, i.e., a $2^m \times n$ LUT, a n-bit ramp value for use at each pixel may be provided to accomplish this mapping in one case. The n-bit value, however, should be monotonically increasing. Moreover, the fidelity with which a given non-linear relationship may be represented depends on the value of "m". Therefore, typically a large value is desired for "m," requiring a look-up-table (LUT) of a relatively much larger size than necessary to support a ramp-based technique. Even worse, programming such a large look-up-table (LUT) may be inefficient, especially when most of the entries in the LUT do not change. As a result, a large LUT may waste precious hardware real estate in some displays.

Thus, there is a continuing need for better ways to form modulated signals that drive display elements with available digital storage.

DETAILED DESCRIPTION

Figure 1:
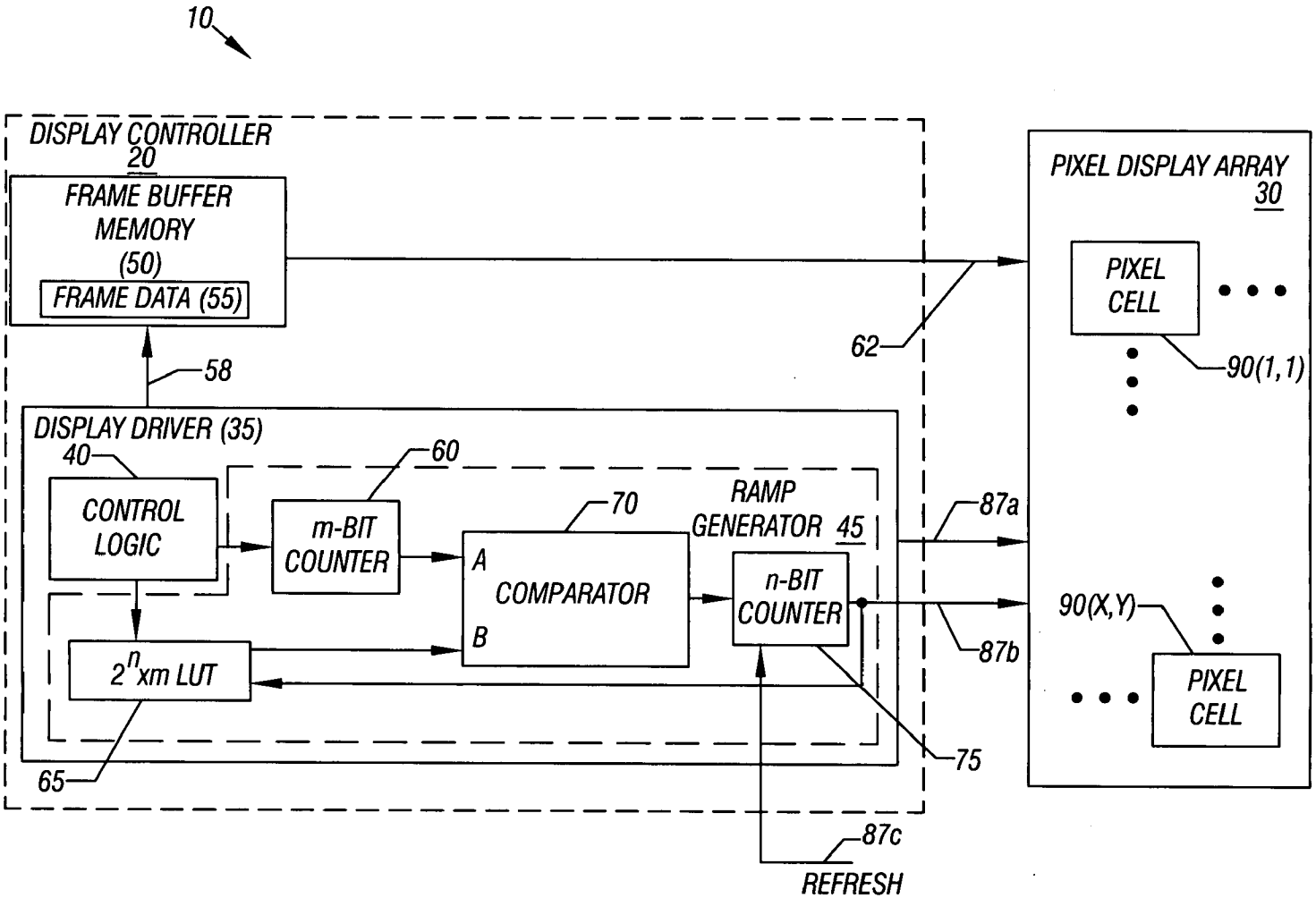
FIG. 1 is a schematic depiction of a display device that programmatically forms modulated signals using pulse width modulation to digitally drive pixel cells in accordance with one embodiment of the present invention.

A display device 10 shown in FIG. 1 includes a display controller 20 for programmably supplying unique values of drive control data as indications (e.g. drive signals) to a pixel display array 30 according to one embodiment of the present invention. The display controller 20 may be programmed to provide the unique updated values for the drive control data that may be used at the pixel display array 30 to generate modulated signals (e.g., using pulse width modulation (PWM)). Accordingly, the modulated signals may be programmatically formed based on selectively updated drive control data, driving the pixel display array 30 in one embodiment of the present invention.

Examples of the display device 10 includes liquid crystal displays (LCDs), flat panel plasma displays and spatial light modulators (SLMs), each comprising one or more display elements. By providing digital storage at the pixel display array 30, the modulated signals may be formed to digitally drive the display elements. For instance, a spatial light modulator (SLM) may use an electric field to modulate the orientation of a liquid crystal (LC) material. By the selective modulation of the LC material, an electronic display of an image may be produced on a screen, as the orientation of the LC material affects the intensity of light going through the LC material. Sandwiching of the LC material between an electrode and a transparent top plate, for example, may enable the modulation of the optical properties of the LC material. When the voltage applied across the electrode and the transparent top plate is changed, the LC material may produce different levels of output intensity, altering the image produced on the screen.

To drive the pixel display array 30, the display controller 20 may comprise a display driver 35. Specifically, the display driver 35 may include a ramp generator 45 that provides only the unique values of the drive control data. In one embodiment, the drive control data may include a ramp value for generating a modulated signal. The display driver 35 may further comprise control logic 40, controlling the ramp generator 45. In addition to display driver 35, the display controller 20 further comprises a frame buffer memory 50, storing frame data 55 in accordance with one embodiment of the present invention.

For example, a ramp-based PWM display controller 20 may be provided to drive the pixel display array 30 in one embodiment of the present invention. Such a ramp-based PWM display controller 20 may iteratively increment the ramp value, starting at a zero value. Using the incremented ramp value, a modulated signal may be formed, digitally driving a display element of the pixel display array 30. Of course, other suitable driving techniques may be deployed in some embodiments.

Consistent with one embodiment of the present invention, the ramp generator 45 includes a m-bit counter 60 and a programmable storage device, such as a look-up-table (LUT) 65. For example, the LUT 65 may be of size $2^n \times m$ where "n" may be the number of bits of the per-pixel display data or pixel value stored in the frame data 55. Likewise, "m" may be representative of the number of discrete steps into which a display refresh period may be divided. For a display refresh period, the m-bit counter 60 may provide a first count at input "A" of a comparator 70. In one embodiment, the first count may be indicative of a modulation characteristic, such as a particular discrete step of a refresh period (or modulation cycle). Corresponding to the first count, the LUT 65 may provide a unique stored value at input "B" of the comparator 70 at which to update a second count. An example of the second count is a display data characteristic, such as the number of bits in the per-pixel display data or pixel value.

The comparator 70 may be operably coupled to both the m-bit counter 60 and the LUT 65, receiving the first count and the unique stored value for comparison purposes. To determine the second count, the comparator 70 may compare the first count to the unique stored value in one embodiment of the present invention. Based on this comparison by the comparator 70, the second count may be generated in a n-bit counter 75, which is communicatively coupled to the comparator 70.

A display of a video frame corresponding to the frame data 55 may be initiated within a display refresh period. In response to a load signal 58 from the display driver 35 to the frame buffer memory 50, the per-pixel display data or pixel value may be provided via a video data signal 62 to the pixel display array 30. While the display driver 35 may provide a start signal 87*a* to the pixel display array 30, the ramp generator 45 may provide the drive control data including a ramp value to the pixel display array 30 via a global signal 87*b*. In one case, a refresh signal 87*c* may be provided to the n-bit counter 75 for starting the ramp value at a non-zero value. By allowing the n-bit counter 75 to reset into a state other than "0" in one embodiment, the ramp generator 45 may start the ramp value at a non-zero value.

In one embodiment, the pixel display array 30 includes a plurality of pixel cells 90 including pixel cells 90 (1, 1) through 90 (X, Y). Each pixel cell 90 may receive the ramp value from the ramp generator 45 to generate a modulated signal. To form the modulated signal, frame data 55 comprising per-pixel display data or pixel value may be provided to each pixel cell 90. As an example, the ramp value may be a common reference, such as a count data that may be provided to each pixel cell 90 in accordance with one embodiment of the present invention. Each pixel cell 90 may comprise a pixel electrode, forming a pixel in one embodiment of the present invention.

For some embodiments of the present invention, the display driver 35 may receive video data input and may scan the display pixel array 30 in a row-by-row manner to drive each pixel electrode of a plurality of pixel electrodes associated with each pixel cell 90, forming a respective pixel. Of course, the display device 10 may comprise any desired arrangement of one or more display elements. Examples of the display elements include spatial light modulator devices, emissive display elements, non-emissive display elements and current and/or voltage driven display elements.

Accordingly, within each display refresh period the per-pixel display data or pixel value associated with each pixel cell 90 may be provided from the frame buffer memory 50 to display a video frame of an image. The per-pixel display data or pixel value may be indicative of an optical output (e.g., intensity) from a particular pixel cell 90 in some embodiments of the present invention. Using an n-bit ramp value received over the global data signal 87*b* and the per-pixel display data or pixel value provided via the video data signal 62, each pixel cell 90 may generate a modulated signal for that display refresh period. In one embodiment, for each display refresh period the modulated signal may include one transition separating a first pulse from a second pulse. The first pulse may indicate an "ON" time for the pixel cell 90 and the second pulse may indicate an "OFF" time.

However, the n-bit ramp value should be monotonically increasing. That is, if the ramp value is "ŕ" when the m-bit counter is "c", then the ramp value, "r", for all counter values c+i (i>0) must meet $\acute{r} \geqq r$. By appropriately programming the $2^m$ entries in the $2^m \times n$ LUT, a non-linear relationship may be established between the m-bit counter value and the n-bit ramp value. The fidelity with which a given non-linear relationship may be represented depends on the value of "m." Therefore, to provide the most fidelity, it may be desirable to make "m" as large as possible because an arbitrary non-linear ramp function may be better represented with increased quantization. But the use of large values for "m" has some significant drawbacks on the ramp value generating hardware, e.g., in a case where "m" is greater than "n" especially in the case where the counter resolution is much larger than the ramp resolution, i.e., $2^m >> 2^n$.

One such drawback involves oversized ramp value generating hardware, requiring look-up-tables of relatively larger size than necessary to support a ramp-based modulation approach. Moreover, most of the entries in such a large look-up-table may be constant. For example, if m=10 and n=8, only 25% of the entries in the LUT may contain unique data, wasting valuable hardware real estate. Additionally, programming of such a large look-up-table may be time consuming because larger look-up-tables take significantly more effort and time to program than the smaller look-up-tables.

Since the ramp value may be monotonically increasing, in one embodiment, encoding may be used to reduce the size of the LUT 65 from $2^m$ to $2^n$ entries. In operation, the comparator 70 maps the m-bit counter 60 output onto a different set of numbers of the n-bit counter 75. Instead of using the LUT 65 of FIG. 1 by itself, the LUT 65 may be advantageously used with the n-bit counter 75 to provide this mapping in some embodiments, substantially decreasing the size of the LUT 65 from $2^m \times n$ to $2^n \times m$, especially when m>>n. In this embodiment, the LUT 65 indicates the value of the m-bit counter 60, (e.g., when "m" is greater than "n") at which the ramp value (i.e., n-bit counter 75) may increment, regardless of the current value of "m." The comparator 70 compares the current m-bit counter value with the n-th entry of the $2^n \times m$ LUT 65 that corresponds to the current ramp value. When this comparison determines that both the current m-bit counter value and the n-th entry are equal, the ramp value advances and the ramp generator 45 begins looking for the next display refresh period interval in which to increment the ramp value because each entry in the LUT 65 indicates a m-bit counter value where the ramp value increments.

Rather than encoding the m-bit counter value at which the n-bit counter 75 increments, in another embodiment, the number of steps of a relatively smaller counter between increments of the n-bit counter 75 may be encoded. In this case, the m-bit counter 60 may become a p-bit counter (where p<m) and the LUT 65 becomes $2^n \times p$ instead of $2^n \times m$. In this embodiment, the number of steps between transitions of the n-bit counter 75 may be expressed in p bits, leading to significantly less hardware in some cases where "m" is relatively large and the deltas between transitions are small.

Figure 2A:
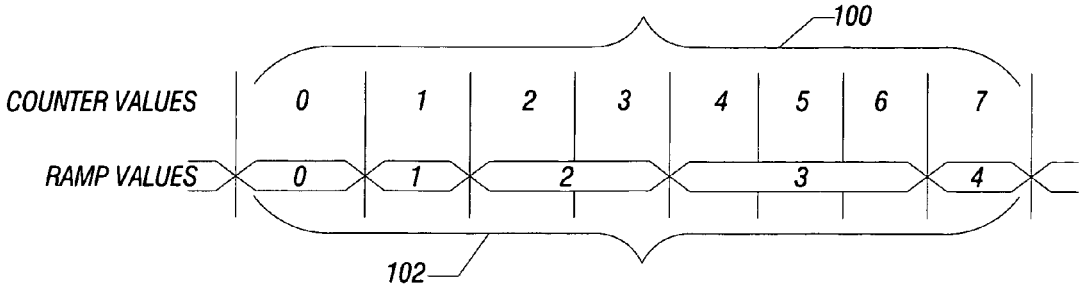
FIG. 2A is an illustrative timing chart for a ramp generator supplying unique updated values of drive control data to each of the pixel cells in the display device shown in FIG. 1 consistent with one embodiment of the present invention.

For programming the LUT 65, an illustrative timing chart shown in FIG. 2A depicts counter values 100 from the m-bit counter 60 relative to ramp values 102 generated by the n-bit counter 75. In the illustrated embodiment, the counter values 100 correspond to first counts with "m" being three and the ramp values 102 correspond to second counts with "n" being three. In one embodiment, the LUT 65 being of size $2^n \times m$ may be programmed to store a subset of the counter values 100 at which a ramp value 102 updates, substantially reducing the size of the LUT 65 from $2^m \times n$ to $2^n \times m$ while supporting a ramp-based PWM algorithm. Because for the eight counter values 100 shown in FIG. 2A, only four ramp values 102 change, i.e., at counter values "1, 2, 4 and 7," a relatively smaller LUT 65 may be provided, storing entries in the LUT 65 with only unique drive control data, such as ramp values 102.

Figure 2B:
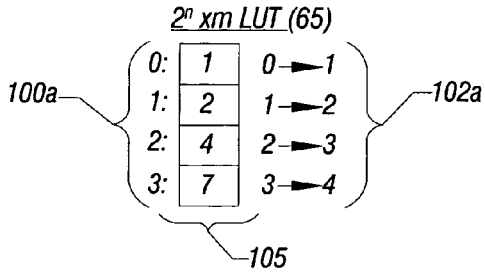
FIG. 2B shows an exemplary programmed look-up-table to cause the update of the drive control data in the ramp generator based on the timing chart shown in FIG. 2A according to one embodiment of the present invention.

A programmed LUT 65 of size $2^n \times m$ is shown in FIG. 2B in which updates for the ramp values 102 indicated in FIG. 2A may be programmed according to one embodiment of the present invention. The programmed LUT 65 indicates a set of four entries 100*a* that correspond to a subset of four unique stored counter values 105 out of the eight counter values 100. As a result, for the unique stored counter values 105 a corresponding set of updated ramp values 102*a* may be provided by looking up the LUT 65. For example, when the counter value 100 changes from "1" to "2," the ramp value 102 gets updated because the counter value "2" is stored as one of the unique stored counter values 105 within the programmed LUT 65. However, when the counter value 100 changes from "2" to "3," the ramp value 102 does not update because the counter value "3" is not stored as one of the unique stored counter values 105 within the programmed LUT 65.

According to one embodiment of the present invention, the control logic 40 shown in FIG. 1 may operate the m-bit counter 60 which may divide the display refresh period into discrete steps, such as a first and a second time interval. For each time interval, the ramp generator 45 may determine whether or not to update a ramp value 102 using a unique stored counter value 105.

Figure 3:
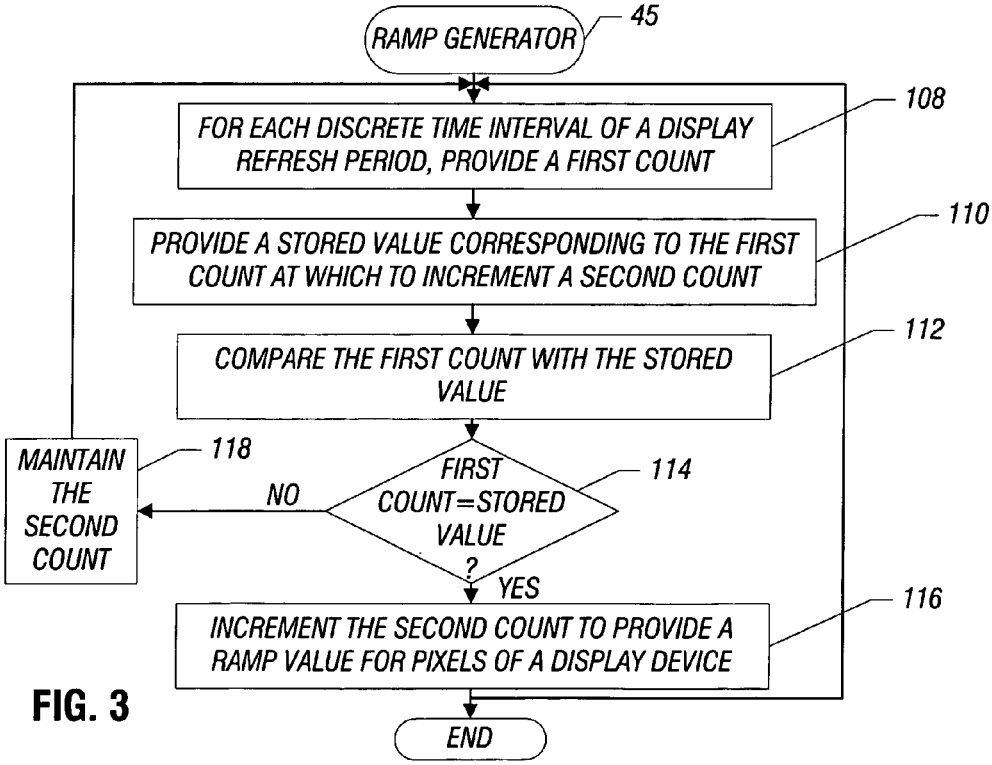
FIG. 3 shows the ramp generator determining the drive control data for digitally driving the pixel display array of the display device of FIG. 1 according to one embodiment of the present invention.

Referring to FIG. 3, using the unique stored counter values 105 shown in the programmed LUT 65 of FIG. 2B, the ramp generator 45 may determine an updated ramp value 102*a* for a ramp value 102. At block 108, for each discrete time interval of a display refresh period, a first count, i.e., a counter value 100 may be received from the m-bit counter 60 at the comparator 70. Likewise, a unique stored counter value 105 shown in FIG. 2B corresponding to the first count may be received from the programmed LUT 65 at block 110. The unique stored counter value 105 may indicate a counter value 100 at which to increment a second count, i.e., a ramp value 102. The comparator 70 shown in FIG. 1 may compare the first count with the unique stored counter value 105 at block 112 to determine whether or not an updated ramp value 102*a* for the current ramp value 102 is programmed.

A check at diamond 114 may determine whether or not the first count, i.e., the counter value 100 is the same as the unique stored counter value 105. If the check at diamond 114 indicates that the first count is indeed the same as the unique stored counter value 105 then, the second count may be incremented at block 116, providing an updated ramp value 102*a* of the ramp value 102 to pixel cells 90 of the pixel display array 30 shown in FIG. 1. Conversely, if the first count is determined to be not equal to the stored counter value 105 at the diamond 114 then, the second count, i.e., the ramp value 102 from the n-bit counter 75 may be maintained at block 118. In this way, the ramp generator 45 may iteratively determine an appropriate update 102*a* for each ramp value 102 in each of the discrete time intervals of the display refresh period.

In one embodiment, the display device 10 (FIG. 1) is a spatial light modulator (SLM) where liquid crystal material (LC) may be driven by circuitry located under each pixel. Of course, there are many reasonable pixel architectures for these devices, each of which have implications on how the LC material is driven. For example, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion. In this case, it is not possible to directly drive the LC material with the digital information, i.e., there needs to be some conversion to an analog form that the LC material can use. Therefore, pulse-width modulation (PWM) is utilized for generating color in an SLM device in one embodiment of the present invention. This enables pixel architectures that use pulse-width modulation to produce color in SLM devices. In this approach, the LC material is driven by a signal waveform whose "ON" time is a function of the desired color value.

Figure 4:
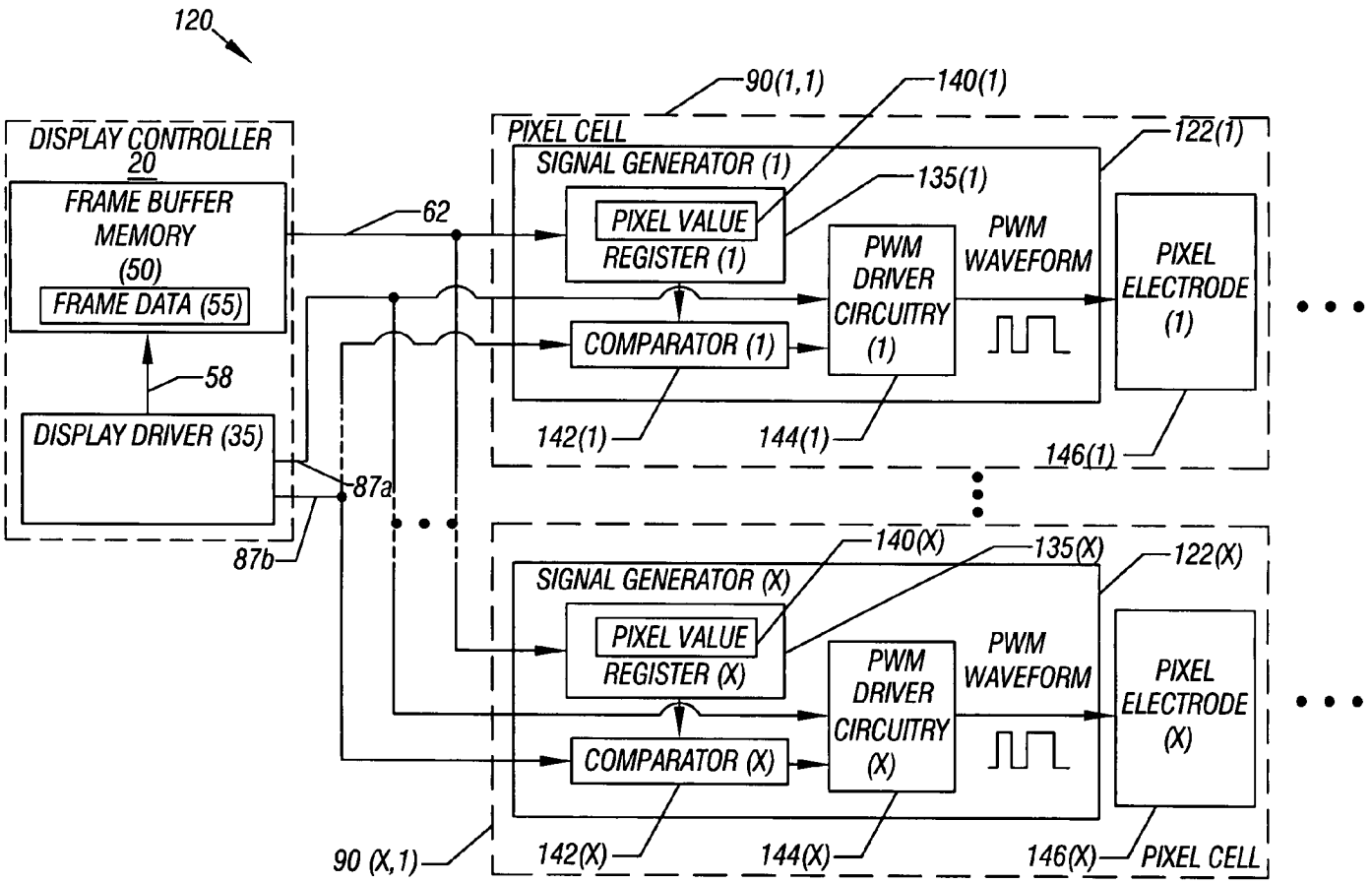
FIG. 4 is a block diagram of per-pixel cell signal generator circuitry with digital storage for the display device shown in FIG. 1 to generate pulse width modulated waveforms that digitally drive pixel cells according to one embodiment of the present invention.

According to one embodiment, the display device 10 may be a nonlinear spatial light modulator (SLM) 120 as shown in FIG. 4. The nonlinear SLM 120 includes the display controller 20 to controllably operate the pixel cells 90 (1, 1) through 90 (X, 1). The display controller 20 may further include the display driver 35 to initiate a display from the frame buffer memory 50 that stores frame data 55 in the illustrated embodiment.

Over the video data signal 62 and the global data signal 87*b*, the display controller 20 may provide digital information that may include global digital information (e.g. drive control data, such as ramp values) and local digital information (e.g., per-pixel display data, such as pixel values) associated with the pixel cells 90 (1, 1) through 90 (X, 1). The nonlinear SLM 120 may further comprise a plurality of signal generators 122(1) through 122(X) where each signal generator 122 may be operably coupled to the display controller 20 for receiving respective digital information for digitally driving the associated pixel cell 90. Each pixel cell 90 may be initialized by the start signal 87*a*. In particular, each pixel cell 90 may be nonlinearly operated by the display controller 20 based on respective digital information provided from the display driver 35 and the frame buffer memory 50.

Each signal generator 122 of the plurality of signal generators 122(1) through 122(X), in the depicted embodiment, may comprise a respective register 135 of a plurality of registers 135(1) through 135(X), a respective comparator 142 of a plurality of comparators 142(1) through 142(X), a respective PWM driver circuitry 144 of a plurality of PWM driver circuitry 144(1) through 144(X) to drive a corresponding pixel electrode 146 of a plurality of pixel electrodes 146(1) through 146(X). Each register 135 of the plurality of registers 135(1) through 135(X) may store the associated digital information including a corresponding pixel value 140 of a plurality of pixel values 140(1) through 140(X) and the count to generate a corresponding nonlinearly pulse width modulated waveform.

By appropriately programming the table entries in the LUT 65, a non-linear relationship between the counter values 100 and ramp values 102 as shown in FIG. 2A may be established. Using the non-linearly programmed LUT 65, each nonlinearly pulse width modulated waveform may be formed for a corresponding pixel electrode 146 of a plurality of pixel electrodes 146(1) through 146(X). The control logic 40 via the LUT 65 may nonlinearly operate each pixel electrode of the plurality of pixel electrodes 146(1) through 146(X) in one embodiment.

Although the comparator 142 shown in FIG. 4 performs a comparison function in the illustrated embodiment, however, other non-comparison functions may advantageously be employed in other embodiments. One non-comparison function may include a decision function instead of a comparison function, in some embodiments. That is, in some embodiments, an input to the PWM driver circuitry 144 may be a Boolean function of the local and shared digital information. When operated, the Boolean function may provide a Boolean result, i.e., either "TRUE" or "FALSE."

According to another embodiment, a processor-based system may be formed to include a plurality of pixel cells, forming a pixel array. Each pixel cell may be driven by a plurality of local drive circuits. Each local drive circuit may be associated with a different pixel cell of the pixel array to receive pixel video data indicative of an optical output from a different pixel cell and receive a dynamically changing drive control data (e.g., ramp values) being shared among the plurality of pixel cells. For each different pixel cell, the corresponding local drive circuit may generate a single-edged PWM waveform.

Figure 5:
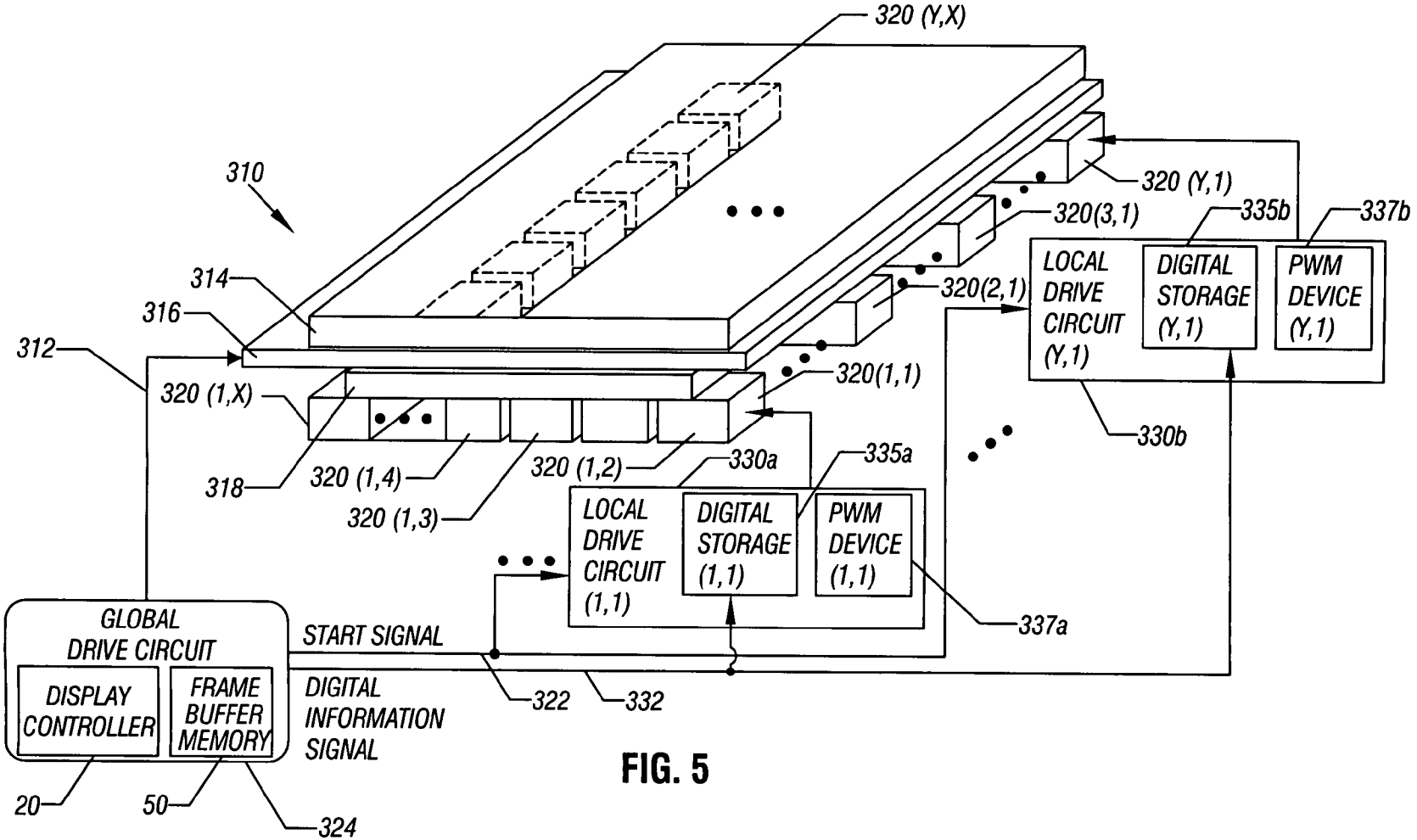
FIG. 5 is a schematic depiction of a display system based on the display device of FIG. 1 for a spatial light modulator according to one embodiment of the present invention.

A processor-based display system 310 corresponding to the display device 10 of FIG. 1 (e.g., a liquid crystal display, such as a spatial light modulator (SLM)) is shown in FIG. 5 to include a liquid crystal layer 318 according to one embodiment of the present invention. Specifically, the liquid crystal layer 318 may be sandwiched between a transparent top plate 316 and a plurality of pixel electrodes 320(1, 1) through 320(Y, X), forming a pixel array comprising a plurality of display elements (e.g., pixels). In some embodiments, each pixel electrode 320 may correspond to the pixel electrode 146 of FIG. 4 in which the top plate 316 may be made of a transparent conducting layer, such as indium tin oxide (ITO).

Applying voltages across the liquid crystal layer 318 through the top plate 316 and the plurality of pixel electrodes 320(1, 1) through 320(Y, X) enables driving of the liquid crystal layer 318 to produce different levels of intensity on the optical outputs at the plurality of display elements, i.e., pixels, allowing the display on the display system 310 to be altered. A glass layer 314 may be applied over the top plate 316. In one embodiment, the top plate 316 may be fabricated directly onto the glass layer 314. A global drive circuit 324 may include the display controller 20 illustrated in FIG. 1 to drive the display system 310. Furthermore, the global drive circuit 324 may comprise the frame buffer memory 50. Digital information including global digital information indicative of a common reference (e.g., drive control data, such as ramp values) and local digital information indicative of an optical output (e.g., per-pixel display data, such as pixel values) from at least one display element, i.e., pixel.

In some embodiments, the global drive circuit 324 applies bias potentials 312 to the top plate 316. Additionally, the global drive circuit 324 provides a start signal 322 and a digital information signal 332 to a plurality of local drive circuits (1, 1) 330*a* through (Y, 1) 330*b*, each local drive circuit 330 may correspond to the signal generators 122 shown in FIG. 4. Each local drive circuit 330 may be associated with a different display element being formed by the corresponding pixel electrode of the plurality of pixel electrodes 320(1, 1) through 320(Y, 1), respectively, such as the pixel cells 90 depicted in FIG. 4.

One technique in accordance with an embodiment of the present invention involves controllably driving the display system 310 using pulse-width modulation (PWM). More particularly, for driving the plurality of pixel electrodes 320(1,1) through 320(Y, X), each display element may be coupled to a different local drive circuit 330 of the plurality of local drive circuits (1, 1) 330*a* through (Y, 1) 330*b*, as an example. To hold and/or store any digital information intended for a particular display element, a plurality of digital storage (1, 1) 335*a* through (Y, 1) 335*b* may be provided, each digital storage 335 may correspond to each register 135 shown in FIG. 4 in one embodiment of the present invention. Each digital storage 335 may be associated with a different local drive circuit 330 of the plurality of local drive circuits (1, 1) 330*a* through (Y, 1) 330*b*, for example.

Likewise, for generating a single-edged PWM waveform based on the respective digital information, a plurality of PWM devices (1, 1) 337*a* through (Y, 1) 337*b* may be provided in order to drive a corresponding display element. In one case, each PWM device 337 of the plurality of PWM devices (1, 1) 337*a* through (Y, 1) 337*b* may be associated with a different local drive circuit 330 of the plurality of local drive circuits (1, 1) 330*a* through (Y, 1) 330*b*. Additionally, each PWM device 337 may correspond to the PWM driver circuitry 144 shown in FIG. 4 in one embodiment.

Consistent with one embodiment of the present invention, the global drive circuit 324 may receive video data input and may scan the pixel array in a row-by-row manner to drive each pixel electrode 320 of the plurality of pixel electrodes 320(1,1) through 320(Y, X). Of course, the display system 310 may comprise any desired arrangement of one or more display elements. Examples of the display elements include spatial light modulator devices, emissive display elements, non-emissive display elements and current and/or voltage driven display elements.

One embodiment of the display system 310 may be based on a digital system architecture that uses pulse-width modulation to produce color in spatial light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a single-edged PWM voltage or current waveforms at a digital pixel level to drive the plurality of digital pixels. Alternatively, the plurality of digital pixels may be configured in any other useful or desirable arrangement.

In one embodiment, the present invention generates a single-edged PWM waveform that generates a single "ON" pulse. Several advantages may be derived in some embodiments. For example, by supporting a system architecture that generates a single "ON" pulse, the device can better control the LC material. This control may be lacking in some situations with approaches that add up multiple non-overlapping pulses to build the PWM waveform. Accordingly, the pixel hardware may be advantageously simplified to allow small sizes. This scheme may allow a duty cycle to vary as a linear function of pixel value with a single "ON" pulse. In this way, PWM may enable digital pixel architectures for SLM devices to design a digital SLM.

In various embodiments of the system 310, a particular application may call for a red-green-blue (RGB) color scheme using one or more sub-pixels. However, the invention is not limited to use in the RGB color space. As another example, one embodiment of the present invention may find utility outside the realm of SLMs, such as in driving flat panel plasma or LCD displays or the like. In one case, frame buffer memory 50 and local drive circuits 330 may be fabricated on more convenient areas of a die, on separate die, or even using different fabrication or semiconductor technologies.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

providing a first count indicative of a modulation characteristic corresponding to a number of discrete steps of a display refresh period;

comparing said first count with a stored value corresponding to a value of said first count at which a second count is to be updated; and updating the second count when the first count equals the stored value to drive a first display element.

2. The method of claim 1, including:

generating a drive control indication corresponding to said second count to form a modulated signal for said first display element; and driving said first display element using the modulated signal.

3. The method of claim 2, including:

selectively updating a ramp value within said drive control indication for said first display element based on the modulation characteristic and the second count; and generating for said first display element the modulated signal including one transition separating a first pulse from a second pulse in response to the ramp value.

4. The method of claim 3, including:

partitioning the display refresh period into a first and a second time interval; and regulating said first count for said first time interval of the display refresh period to update said second count at said first display element, wherein said second count is common between said first and a second display element.

5. The method of claim 4, including:

sending to said first display element a first digital data indicative of an optical output therefrom; and deriving the timing of said one transition of the modulated signal within the display refresh period based on said first digital data and said comparison of said first count and the stored value.

6. The method of claim 4, including incrementing said second count when said first count and the stored value are determined to be substantially equal.

7. The method of claim 4, including maintaining said second count when said first count and the stored value are determined to be different.

8. The method of claim 3, including:

determining a logic state of the modulated signal based on the timing of said one transition; and performing pulse width modulation to form the modulated signal.

9. The method of claim 1, including programmably storing only unique values of the stored value at which said second count is updated.

10. An apparatus comprising:

a first display element; and a controller operably coupled to said first display element to compare for a display refresh period a first count indicative of a modulation characteristic corresponding to a number of discrete steps of a display refresh period with a stored value that corresponds to said first count in order to determine a second count indicative of a display data characteristic corresponding to a number of bits in a pixel value, wherein the stored value is indicative of an update for said second count, said controller further comprising a ramp generator including a first counter to provide said first count, a first storage device to store the stored value, a comparator to compare said first count with the stored value, and a second counter coupled to an output of the comparator to provide said second count to drive said first display element.

11. The apparatus of claim 10, said ramp generator to:

generate a drive control indication including a ramp value corresponding to said second count; and selectively update the ramp value for said first display element based on the modulation and display data characteristics.

12. The apparatus of claim 11, further comprising a signal generator associated with said first display element to form a modulated signal including one transition to separate a first pulse from a second pulse in response to the ramp value.

13. The apparatus of claim 12, said controller further comprising control logic to:

start a display of a video frame within the display refresh period;

set the modulated signal to an "ON" logic state at the beginning of said video frame;

partition the display refresh period into a first and a second time interval; and regulate said first count for said first time interval of the display refresh period to update said second count at said first display element, wherein said second count is common between said first and a second display element.

14. The apparatus of claim 13, said signal generator further comprising:

a second storage device to receive at said first display element a first digital data indicative of an optical output therefrom; and driver circuitry operably coupled to said second storage device to derive the timing of said one transition of the modulated signal within the display refresh period based on said first digital data and said comparison of said first count and the stored value.

15. The apparatus of claim 12, wherein said signal generator comprises a pixel comparator to compare the ramp value to the pixel value for the first display element.

16. The apparatus of claim 10, wherein said first storage device includes a look-up table to programmably store only unique values of said first count at which said second count is updated.

17. The apparatus of claim 16, said driver circuitry to perform pulse width modulation to form the modulated signal that provides the optical output from the first display element.

18. A system, comprising:

a plurality of pixel cells that form a pixel array;

a frame buffer to provide frame data indicative of an optical output to a different pixel cell of the pixel array; and a ramp generator operably coupled to the pixel array to compare a first count indicative of a modulation characteristic corresponding to a number of discrete steps of a display refresh period with a stored value from a storage in order to update a ramp value, wherein the storage includes a plurality of stored values each having a unique value to indicate a value of the modulation characteristic at which the ramp value is to be updated.

19. The system of claim 18, further comprising:

a plurality of drive circuits, each said drive circuit operably coupled with said different pixel cell of the pixel array to use said ramp value and frame data once in a display refresh period to generate a modulated signal to drive said different pixel cell of the pixel array.

20. The system of claim 19, wherein for each said drive circuit said ramp generator to:

generate a drive control indication including the ramp value corresponding to a display data characteristic; and selectively update the ramp value for said different pixel cell of the pixel array based on the modulation and display data characteristics.

21. The system of claim 20, further comprising a signal generator associated with said different pixel cell of the pixel array to form for said different pixel cell of the pixel array in the display refresh period a modulated signal including one transition to separate a first pulse from a second pulse in response to the ramp value.

22. The system of claim 21, further comprising control logic to:

start a display of a video frame within the display refresh period;

set the modulated signal to an "ON" logic state at the beginning of said video frame;

partition the display refresh period into a first and a second time interval; and regulate said modulation characteristic for said first time interval of the display refresh period to update said ramp value at said different pixel cell of the pixel array, wherein said display data characteristic is common for the pixel array.

23. The system of claim 22, said signal generator further comprising:

a storage device to receive at said different pixel cell of the pixel array said frame data indicative of an optical output therefrom; and driver circuitry operably coupled to said storage device to derive the timing of said one transition of the modulated signal within the display refresh period based on said frame data and said comparison of said modulation characteristic and the stored value.

24. The system of claim 23, said driver circuitry to perform pulse width modulation to form the modulated signal that provides the optical output from said different pixel cell of the pixel array.

25. The system of claim 24, wherein the pixel array comprises a liquid crystal display.

26. The system of claim 25, wherein the liquid crystal display comprises a spatial light modulator.

27. The system of claim 21, wherein said signal generator comprises a pixel comparator to compare the ramp value to the pixel value for said different pixel cell of the pixel array.

28. The system of claim 18, wherein the ramp generator comprises a counter coupled to receive a value of the comparison and to generate the ramp value therefrom, wherein the ramp value is fed back to the storage.

29. The system of claim 18, wherein the ramp generator comprises a first counter to generate the modulation characteristic, a comparator coupled to receive the modulation characteristic and the stored value, and a second counter coupled to an output of the comparator, the second counter to generate the ramp value.

* * * * *